United States Patent [19]

Dix

[11] 4,080,266

[45] Mar. 21, 1978

[54] CLOSURE FOR AN OPENING OF A COKING OVEN

[75] Inventor: Kurt Dix, Bochum, Germany

[73] Assignee: G. Wolff Jr. Kommanditgesellschaft, Bochum-Linden, Germany

[21] Appl. No.: 759,402

[22] Filed: Jan. 14, 1977

[30] Foreign Application Priority Data

Jan. 17, 1976 Germany ..... 2601708

[51] Int. Cl.[2] ..... C10B 1/06; C10B 25/06; C10B 25/16

[52] U.S. Cl. ..... 202/248; 202/269

[58] Field of Search ..... 202/242, 228, 269; 34/242; 220/228, 378

[56] References Cited

U.S. PATENT DOCUMENTS

| | | | |
|---|---|---|---|
| 2,085,775 | 7/1937 | Van Ackeren | 202/248 |
| 2,662,053 | 12/1953 | Brown | 202/269 |
| 2,744,858 | 5/1956 | Homan | 202/269 |
| 2,778,785 | 1/1957 | Otto | 202/248 |
| 3,172,825 | 3/1965 | Maloney | 202/248 |
| 3,705,087 | 12/1972 | Grumm et al. | 202/248 |
| 3,876,502 | 4/1975 | Dix et al. | 202/248 |
| 4,016,046 | 4/1977 | Van Ackeren et al. | 202/269 |
| 4,028,193 | 6/1977 | Nagayoshi | 202/269 |
| 4,033,827 | 7/1977 | White | 202/248 |
| 4,036,702 | 7/1977 | Nagayoshi | 202/248 |

FOREIGN PATENT DOCUMENTS

| | | | |
|---|---|---|---|
| 463,262 | 3/1937 | United Kingdom | 202/248 |

*Primary Examiner*—Morris O. Wolk
*Assistant Examiner*—Bradley R. Garris
*Attorney, Agent, or Firm*—Michael J. Striker

[57] ABSTRACT

A closure for an opening of a coking oven includes a door receivable in an opening of a circumferentially complete frame mounted on the coking oven, with a clearance therefrom. The clearance is sealed by a sealing member adjustably mounted on the door and contacting a contact surface of the frame in the closing position of the door. The contact surface of the frame and the sealing member are protected from deposition of volatile byproducts of the coking process thereon by an outwardly projecting circumferentially complete stepped ridge provided on the frame in between the open end of the opening and the contact surface of the frame. At least one groove may circumferentially surround the open end of the opening, and the door may have regions juxtaposable with the steps of the ridge and with the groove and having configurations complementary to the ridge and the groove to define a labyrinthine passage for the volatile byproducts between the open end and the contact surface of the frame. A generally U-shaped sheet member of resilient properties may be interposed between and bear against the door and the frame.

21 Claims, 7 Drawing Figures

CLOSURE FOR AN OPENING OF A COKING OVEN

BACKGROUND OF THE INVENTION

The present invention relates to a closure for an opening of a coking oven in general, and more particularly to a closure to be used on a horizontal coking oven.

Coking ovens of this type are, of course, already known, and they include walls which bound a coking chamber, at least one charging and/or discharging opening being provided in such walls. It is also already known to provide a closure for such an opening, which usually includes a circumferentially complete frame mounted on the coking oven around the opening, and a door which is partially receivable in the frame and is adapted to be releasably and removably held in a closing position thereof by appropriate holding arrangements. The door is usually received in the opening with a clearance from the frame, and sealing arrangements are provided which seal the clearance and thus prevent escape of volatile by-products of the coking process from the coking chamber through the clearance between the door and the frame.

Experience with the conventional coking ovens having closures of this type has shown that the above-discussed conventional closures leave much to be desired. One of the gravest problems which is encountered during the use of the conventional closures is that, of necessity, temperature differentials exist between various parts of the closure. So, for instance, different temperature prevail in different regions of the coking chamber during the coking operation and, consequently, also the portions of the closure which are contiguous with such regions will be at different temperatures. Thus, for example the temperature of the lower portions of the frame and of the door will be lower than that of the upper portion. Also, the outlaying zones of the closure will be at a lower temperature than the zones which are closer to the source of heat, that is, the coal being coked.

As a result of these temperature differentials, the coal gas containing volatile by-products of the coking operation, such as tar or pitch vapors, which will penetrate into the clearance between the door and the frame, will be subjected to cooling in the clearance to a temperature below that at which the pitch or tar vapors condense, or even below the temperature at which the liquid pitch or coal tar solidify. This will result in the formation of incrustations at some zones of the closure.

These incrustations are very disadvantageous in that they can interfere with the sealing of the clearance between the door and the frame so that the tar or pitch vapors which are noxious and create health hazards can escape into the environment of the coking oven. This disadvantage is particularly pronounced when the incrustations form, as they will because of the relatively low temperature prevailing there, at the sealing arrangement which seals the clearance.

To eliminate the disadvantageous effects of the formation of incrustations, and in particular in order to obtain sufficient seal for the clearance between the door and the frame, it was heretofore necessary to remove the incrustations from time to time, with the door removed from the frame, by using special cleaning procedures. It was particularly necessary to remove incrustations from the contact surfaces of the frame and also from the sealing members contacting such contact surfaces in the closed position of the door. These heretofore mandatory cleaning operations involved a considerable time expenditure, and resulted in a not insubstantial mechanical wear and tear of the contact surfaces of the frame as well as of the sealing member. The mechanical influences also regularly result in destruction of the sealing members, so that it was necessary to quite frequently recondition or rebuild one or more of the components which constitute the seal, or even to replace such worn out components by new ones.

To alleviate this situation, it has already been proposed to so construct the seal as to include two separate sealing arrangements, one downstream of the other as considered in the direction of penetration of the coal gas into and through the clearance. One of the sealing arrangements, which is located inwardly and faces the region of the frame which surrounds the opening, may be of metallic material, and the other sealing arrangement which is located radially outwardly of the just mentioned sealing arrangement and which is in contact with the ambient air may be of a packing material. In this proposed construction, the frame is provided with separately situated inner and outer contact surfaces and, in the closing position of the door, the inwardly situated metallic sealing member abuts the inner contact surface and the outer packing member abuts the outer contact surface of the frame. The idea behind this proposed construction was that the packing member would provide for the hermetic sealing of the clearance, while the metallic member would prevent penetration of the volatile by-products of the coking operation to the packing member and thus prevent formation of the incrustations at the latter.

It has also been proposed, in the closure of this type, to offset the external surface of the frame in such a manner that the radially outer contact surface is provided on a step of a greater magnitude than that on which the inner contact surface is provided. The reason for this offset arrangement of these two contact surfaces was to prevent wetting of the outer contact surface by tar which may be able to penetrate between the metallic member and the inner contact surface. Thus, the provision of the outer contact surface on a higher step was supposed to block the flow of the tar onto the outer contact surface. The apparent purpose of this arrangement was not only to prevent soiling of the outer contact surface, but also damage to the packing member. However, experience with the coking ovens using this type of closure has shown that the above-discussed expectations have materialized only to a very limited extent. In particular, it has been established that, despite the above-discussed expedients, it is still necessary to attend to numerous and expensive cleaning operations in the regions of the contact surfaces and of the metallic and packing members.

SUMMARY OF THE INVENTION

Accordingly, it is a general object of the present invention to avoid the disadvantages of the prior art.

More particularly, it is an object of the present invention to design a closure for a coking oven which is not possessed of the above-discussed disadvantages of the prior art closures.

It is a further object of the present invention to so construct the closure that it assures gas-tight sealing of the clearance between the door and the frame during a number of coking cycles.

It is still another object of the present invention to devise a closure of the above-discussed type in which it is not necessary to remove incrustations which have developed on the frame or on the door of the closure, particularly on the sealing arrangement provided thereon, after only a short period of operation of the coking oven.

A concomitant object of the present invention is to so configurate the closure that excellent sealing effect is obtained, even when using only a single sealing arrangement.

In pursuance of these objects and others which will become apparent hereafter, one feature of the present invention resides, briefly stated, in a closure for an opening in a coking oven which comprises a circumferentially complete frame mounted on the coking oven and bounding at least an outwardly open end of the opening; a door receivable in the opening with clearance from the frame; means for removably holding the door in a closing position thereof with respect to the frame for closing the opening; means for sealing such clearance, including a contact surface on the frame about the open end of the opening and with spacing therefrom, at least one sealing member having a sealing portion juxtaposable with the contact surface, and means for connecting the sealing member to the door for adjustment of the position of the former relative to the latter and for retaining the support member in an adjusted position thereof, in which the sealing portion sealingly contacts the contact surface of the frame in the closing position of the door; and means for protecting the sealing means from deposition of volatile by-products of the coking process thereon, including an outwardly projecting ridge on the frame in between the open end of the opening and the contact surface of the frame. The frame has respective lateral, lower and upper portions, and the ridge may be provided at the lateral and lower portions of the frame. However, for many reasons, including the ease of manufacturing, it is proposed to provide the ridge all the way around the open end of the opening. At least a portion of, but preferably the entire ridge, has a stepped configuration, that is it has a plurality of steps of gradually decreasing magnitude as considered from the open end of the opening to the contact surface. Advantageously, the contact surface of the frame is inwardly offset with respect to the respective step which has the largest magnitude.

The provision of the ridge, and particularly the configurating thereof in a stepped-like manner results in a situation in which the contact surfaces of the frame and the sealing member or members which are connected to the door are substantially free of incrustations even after a number of coking cycles. As a result of this, cleaning and reconditioning operations which had heretofore to be performed on the various components of the closure can be, to a great extent, dispensed with when the closure of the present invention is used.

The reason for the lack or retardation of the formation of the incrustations results from the fact that the ridge and the externally facing steps of the frame reduce the possibility that the volatile by-products of the coking operation could penetrate towards and deposit on the contact surfaces and on the sealing members, to any appreciable extent. This is attributable to the fact that the steps constitute a substantial obstruction to the flow of the condensates which develop in the region of the opening of the frame, thus hindering the condensates in their flow toward the contact surfaces and toward the sealing members. These obstructions in the path of flow of the condensates have especially beneficial effects in the region of the lateral portions of the frame and of the door where each edge at the region of merger of the various steps acts as a dripping edge. Thus, the stepped region between the frame and the door constitutes a locking and storing space for the condensates.

At the remote region of the frame and of the door, especially at the lower transverse zone thereof, this kind of stepped configuration has the result that the condensates which form close to the opening of the frame can freely flow downwardly, after the door has been lifted from the frame at the termination of a coking cycle, as well as during the time that the door is removed from the frame prior to the next coking cycle, under the influence of their own gravity. During their free gravitational fall, the condensates do not come into contact with the contact surface of the frame located downwardly of, but inwardly offset from the step of greatest magnitude, and thus soiling of the respective lower contact surface by the condensates is avoided. This obtains even then when a stream of air is directed against the region of the opening and against the frame, from the exterior of the coking oven.

When this concept is utilized in a closure which has a bipartite sealing arrangement, that is which has an inner seal and an outer seal separate from and radially outwardly distant from the inner seal, which seals, in the closed position of the door, come into contact with two radially outwardly spaced contact surfaces of the frame, the stepped configuration of the ridge accomplishes the advantage that even the inwardly situated separate seal and the associated contact surface of the frame are not wetted by the condensates.

It is currently preferred that the frame, particularly the ridge thereof, has at least three steps between the open end of the opening and the contact surfaces. Advantageously, at least four steps are provided.

A particularly advantageous prevention of the penetration of the condensates to the contact surfaces of the frame and the sealing members is obtained when each step which is closer to the open end of the opening of the frame than the radially outwardly adjacent step is of a greater magnitude than such adjacent step. In this event, the danger of wetting of the contact surfaces is reduced, even after removal of the door from the frame.

To enhance the dripping of the condensates forming during the operation of the coking oven, due to their own gravity, at least one drip projection is formed on the frame, particularly at the lower region of the frame underneath the openings.

Such drip projection preferably extends from the ridge in direction toward the contact surface of the frame. It is currently preferred that the drip projection be provided on the respective step of the plurality of steps which has the largest magnitude.

It is further advantageous when the door has regions which are juxtaposed with the ridge in the closing position, such regions having stepped configurations which are substantially complementary to those of the steps of the ridge. In this manner, the frame and the door bound a narrow and contorted channel in the stepped zones thereof, and the steps of the above-mentioned regions of the door act as additional obstructions preventing penetration of the condensate towards the contact surfaces as well as toward the sealing members of the sealing arrangements.

The wetting of the contact surface and of the sealing members by condensates is avoided, to an even greater degree, when at least one groove is provided on the frame between the open end of the opening and the contact surfaces, such groove extending parallel to the edges of the steps. In this connection, it is further advantageous when each groove, if there are more than one, is arranged at a side of a respective step which is distant from the open end of the opening. It is further advantageous when each of the grooves extend all the way about the opening of the frame. When such a groove is provided, the door may be formed with at least one bulge which is received in such groove in the closed position of the door, so that the labyrinthine path or passage is defined between such bulge and such groove. In this manner, the flow of the condensates toward the contact surfaces and toward the sealing members is further hampered.

The wetting of the contact surfaces and of the sealing members by condensates is further avoided by arranging at least one sheet member of generally U-shaped configuration between the door and the frame in the stepped region of the latter, such sheet member extending in the circumferential direction of the ridge. This sheet member, or a plurality of such sheet members, can entirely prevent the penetration of the condensates toward end zones of the closure which are critical for achieving the sealing effect.

It is advantageous when the sheet members are detachably mounted or interposed between the door and the frame. This results in a situation in which the sheet members can be easily replaced in the open position of the door, after condensates or incrustations have been formed on such sheet members. In addition thereto, it is advantageous when the sheet members are of a resilient material, inasmuch as it can then be achieved that the sheet members remain in contact with the door and/or frame, as a result of their resiliency, even when the frame or the door has suffered deformation due to temperature differentials existing within the same. It is currently preferred to arrange or interpose the sheet member or members at least between the lateral and lower portions of the door and the frame.

In one currently preferred embodiment of the present invention the sheet member is so interposed between the door and the frame that the bight of the sheet member rests against the door and the arms of the sheet member which are connected to the bight abut the frame in the closed position of the door. However, the shielding of the contact surfaces and the sealing action of the sheet members are especially effective when the bight of the sheet member is received in a groove of the frame and when one of the arms connected to the bight abuts against the frame and the other arm rests against the door.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
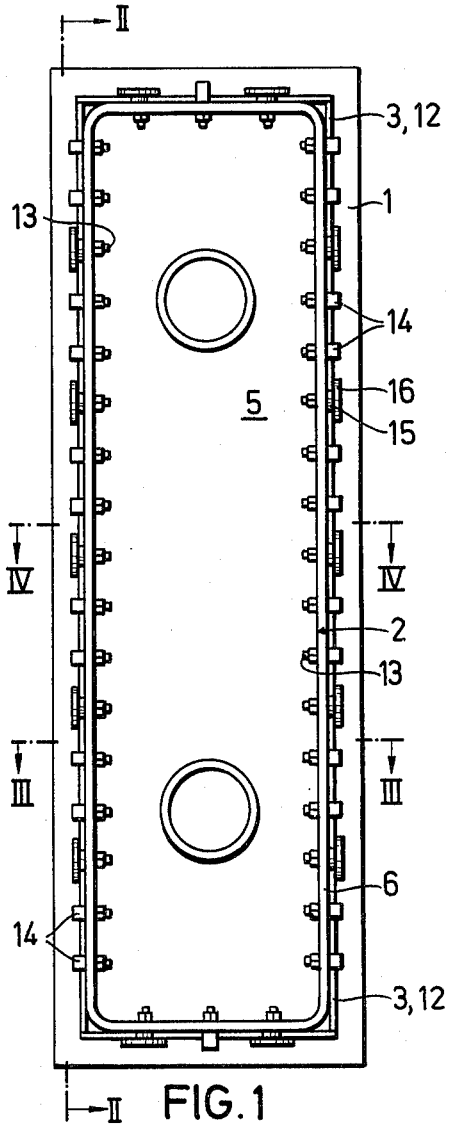
FIG. 1 is a front elevational view for a closure according to the present invention.
Figure 2:
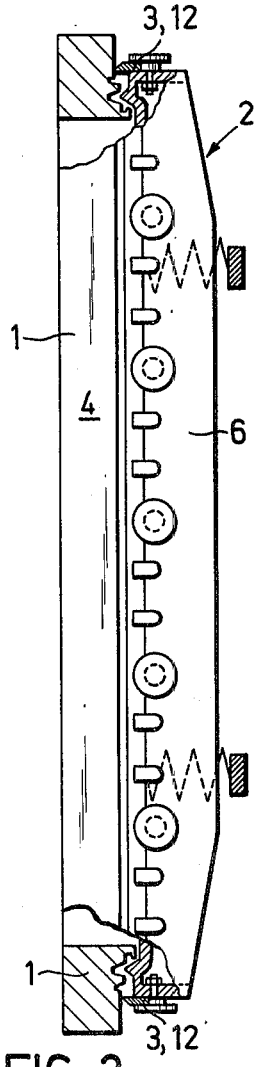
FIG. 2 is a sectional view taken on line II—II of FIG. 1.

Referring now to the drawing in detail, and first to FIGS. 1 through 4 thereof, it may be seen that they illustrate a closure for a preferably horizontal coking oven, which has been omitted from the drawing for the sake of clarity. The closure includes a circumferentially complete frame 1, a door 2, and a sealing arrangement designated with the reference numeral 3. Preferably the frame 1 is of cast iron, and the door 2 is either of grey cast iron or of spheroidal graphite iron. In the closing position of the door 2, the seal 3 abuts against the frame 1.

The door 2 has a substantially U-shaped cross-section, and it includes a door bottom 5 which is receivable in an opening 4 of the frame 1 and closes the same, as well as radially outwardly extending walls 6. The door bottom 5 carries, on its side which faces toward the coking chamber of the coking oven in the closed position of the door 2, a holder 7 for a refractory lining 8, such as masonry construction, which is received in and plugs the opening 4 of the frame 1 in the closing position of the door 2.

The door 2 is connectable to the frame 1 by means of two latching arrangements. These latching arrangements are only indicated in FIGS. 1 and 2. However, in FIGS. 3 and 4, there is illustrated one of the latching arrangements. Each latching arrangement includes a pivotally mounted closing latch 9 which resiliently presses against the latching members 10 laterally provided on the frame 1. Such latching arrangements are per se known so that they need not be discussed in greater detail.

Figure 3:
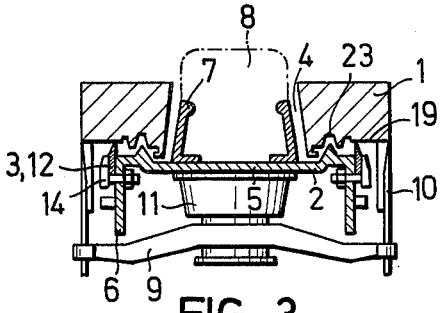
FIG. 3 is a sectional view taken on line III—III of FIG. 1.
Figure 4:
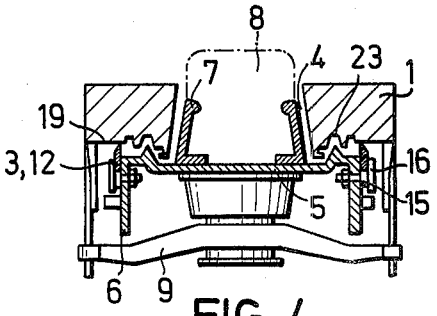
FIG. 4 is a view similar to FIG. 3 but taken on line IV—IV of FIG. 1.

As particularly seen in FIGS. 3 and 4, there is provided a one-part seal 3. It includes a sealing member 12, preferably of a metallic material which is mounted on the door 2 for displacement in horizontal direction toward the frame 1 relative to the door 2, and which circumferentially surrounds the portion of the door to which it is mounted. The sealing member 12 is frictionally retained on the door 2 in the region of walls 6 of the latter. In order to frictionally retain the sealing member 12, bores are provided in the door wall 6, being distributed about the circumference of the door walls 6. Screws 13 or similar holding elements are accommodated in such bores. As one possibility which is illustrated in FIG. 3, a hook 14 is mounted at the free end of the shank of the respective screw 13 which confines the sealing member 12 between itself and the wall 6. As another possibility illustrated in FIG. 4, a cam plate 15 and a clamping plate 16 with an adjustment head 17 is mounted at the free end of the shank of the respective screw 13. Thus, the sealing member 12 is clamped between either the hook 14 and the wall 6 or between the clamping plate 16 and the wall 6. The outer circumferential surface of each cam plate 15 has the configuration of a segment of a spiral having the axis of the respective screw 13 as its axis.

When the frame 1 and/or the door 2 deform as a result of heat-caused dilatations, which occur during the operation of the coking oven, it is possible, in a simple manner to displace the sealing member 12 closer to the frame 1 by directing impacts against the back of the sealing member 12. When the sealing member 12 as will ordinarily be the case, is originally in contact with the cam plate 15 when the door 2 is mounted in the frame 1 prior to the commencement of the coking cycle, the directing of the impacts against, and the ensuing displacement of, the sealing member 12 results in the formation of a gap between the back of the sealing member 12 and the cam disc 15. In order to restore the contact of the back of the sealing member 12 with the cam plate 15 that is, in order to arrest the sealing member 12 in its adjusted, displaced position, it is merely necessary to rotate the adjustment head 17 to such an extent that the cam disc 15 contacts the back of the sealing member 12. The required direction of rotation is indicated in FIG. 7 by an arrow X.

The sealing member 12 has a marginal portion 18 which is juxtaposable with the frame 1 and which converges in direction to the latter. The marginal portion 18, and especially the tip thereof, comes into contact with a flat contact surface 19 of the frame 1 when the door 2 is in its closing position. The contact surface 19 circumferentially surrounds the opening 4 for the frame 1.

The frame 1 has a stepped configuration in between the opening 4 and the contact surface 19, circumferentially about the opening 4. The opening 4 has an axis Y central thereto, and the frame 1 has a ridge which has the above-mentioned stepped configuration. The steps of the ridge have different magnitudes as considered in the direction of the axis Y of the opening 4. Thus, the frame 1 and the door 2 define, in the stepped regions thereof, a condensate locking and collecting space. The contact surface 19 of the frame 1 is inwardly offset from a step 20 which extends to the greatest extent outwardly of the frame 1.

Figure 5:
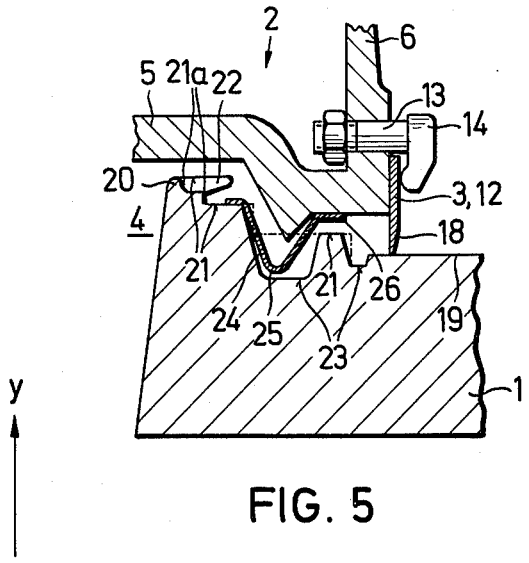
FIG. 5 is a sectional view of a detail of FIGS. 3 and 4.
Figure 6:
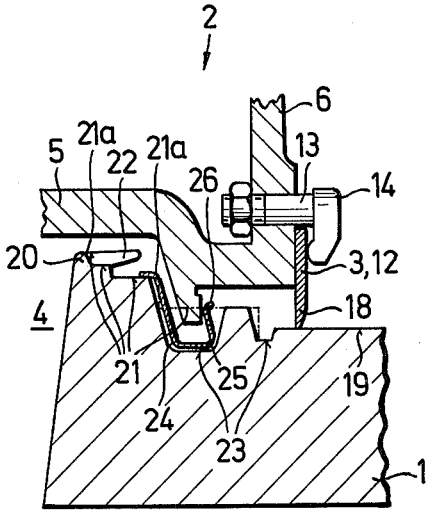
FIG. 6 is a sectional view similar to FIG. 5 but of a modification.
Figure 7:
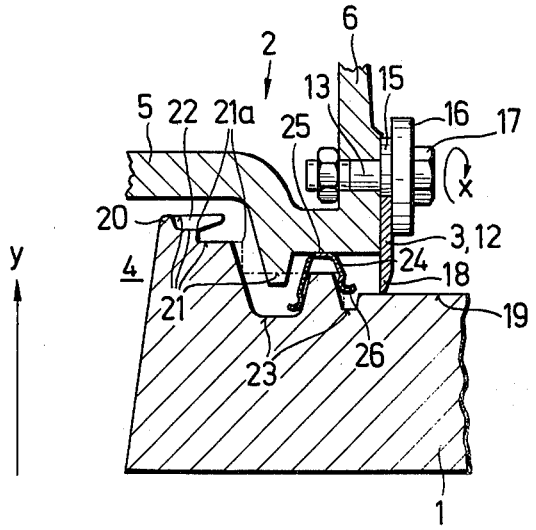
FIG. 7 is a sectional view similar to FIG. 5 but of a further modification.

As illustrated in the drawings, the ridge of the frame 1, which is situated between the opening 4 and the contact surface 19, has four steps 21 which are schematically indicated in FIGS. 5, 6 and 7 in dashed lines. The stepped configuration is so selected that each step 21 which is situated closer to the opening 4 of the frame 1 has a greater magnitude than the respective radially outwardly adjacent step 21.

The frame 1 is further equipped, around the lower transverse portion of the lower part of the lateral portions of the frame 1 and of the door 2, in the region of the opening 4, with an outwardly extending nose-shaped projection 22 which has the shape of a drip projection. The projection 22 is provided on the step 20 which extends to the great distance outwardly of the frame 1 and which is located immediately adjacent the opening 4.

The bottom 5 of the door 2 has regions which are juxtaposed with the ridge of the frame 1, such regions also being stepped in the same sense as the steps 20, 21 of the ridge of the frame 1, so that the distance between the ridge of the frame 1 and these regions of the bottom 5 of the door 2 remains virtually constant throughout the stepped zone of the frame 1 and of the door 2.

The steps 21 have edges 21*a*, and two grooves 23 which extend substantially parallel to the edges 21*a* of the steps 21 are provided in the frame 1. Each of the grooves 23 is always situated at the side of the respective step 20 of the stepped ridge of the frame 1 which is remote from the opening 4.

The grooves 23 are provided on those steps 21 which are closest to the contact surface 19. Preferably, the grooves 23 surround the entire circumference of the opening 4. In addition thereto, the bottom 5 of the door 2 has a bulge which is received in the groove 23 that is closer to the opening 4, to define a labyrinthine passage therewith. This labyrinthine passage further reduces the likelihood that volatile by-products of the coking operation, such as tar or pitch vapors, could penetrate toward the seal 3 to condense thereon.

Referring now to FIGS. 5—7, it may be seen therein that resilient sheet members 24 are detachably interposed between the frame 1 and the door 2 in the stepped zones thereof.

Each of the sheet members 24 is elongated, and extends in the circumferential direction of the frame 1 and of the door 2, and is of a generally U-shaped configuration. The sheet member 24 or a plurality of such sheet members may be arranged at all sides of the opening 4 in the clearance between the door 2 and the frame 1. However, it is currently preferred that sheet members 24 are only arranged at the lateral portions and the lower transverse portion of the frame 1.

In the modifications illustrated in FIGS. 5 and 6, a bight 25 of the respective sheet member 24 is received in the groove 23 which is closer to the opening 4 of the frame 1 then the other groove 23. On the other hand, arms 26 of the sheet member 24 abut against the frame 1, on the one hand, and rest against the door 2, on the other hand. In the modification illustrated in FIG. 5, one arm 26 abuts against a region of the bottom 5 of the door 2 which extends transverse to the axis Y and thus is compressed in the longitudinal direction of coke oven. On the other hand, as illustrated in FIG. 6, one arm 26 abuts against a region of the bottom 5 of the door 2 which is parallel to the axis Y, thus is compressed in the transverse direction of the coking oven.

As illustrated in FIG. 7 the bight 25 is substantially normal to the axis Y so that the bight 25 of the respective sheet member 24 rests against bottom 5 of the door 2, and the arms 26 abut against the frame 1. Thus, the arms 26 extend in the longitudinal direction of the coking oven and the bight 25 extends in the transverse direction of the coking oven.

It will be understood that each of the elements described above, or two or more together, may also find a useful application in other types of constructions differing from the types described above.

While the invention has been illustrated and described as embodied in a closure for an opening of a coking oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A closure for an opening of a coking oven, comprising a circumferentially complete frame mounted on the coking oven and bounding at least an outwardly open end of the opening; a door receivable in the opening with clearance from said frame; means for removably holding said door in a closing position thereof with respect to said frame for closing the opening; means for sealing said clearance, including a contact surface on said frame about the open end of the opening and with spacing therefrom, at least one sealing member having a sealing portion juxtaposable with said contact surface, and means for connecting said sealing member to said door for adjustment of the position of said sealing member relative to said door and for retaining said sealing member in an adjusted position thereof in which said sealing portion sealingly contacts said contact surface of said frame in said closing position of said door; and means for protecting said sealing means from deposition of volatile by-products of the coking process thereon, including a ridge on said frame in between the open end of the opening and said contact surface of said frame said ridge projecting outwardly with respect to said frame such that the terminal end of said ridge lies beyond said contact surface in a direction substantially perpendicular to said contact surface and away from the coking oven.

2. A closure as defined in claim 1, wherein at least a portion of said ridge has a stepped configuration.

3. A closure as defined in claim 1, wherein said ridge extends all the way around the periphery of the opening.

4. A closure as defined in claim 1, wherein said ridge has at least three steps of different magnitude.

5. A closure as defined in claim 1, wherein said ridge has at least four steps of different magnitude.

6. A closure as defined in claim 1, wherein said ridge has a plurality of steps gradually decreasing magnitude as considered from the open end of the opening to said contact surface.

7. A closure as defined in claim 6, wherein said contact surface of said frame is inwardly offset with respect to the respective step which has the largest magnitude.

8. A closure as defined in claim 6, wherein said door has regions which are juxtaposed with said ridge in said closing position, said regions having stepped configurations which are substantially complementary to those of said steps of said ridge.

9. A closure as defined in claim 6, wherein said frame is provided with at least one groove between the open end of the opening and said contact surface of said frame, said groove extending substantially parallel to said steps of said ridge.

10. A closure as defined in claim 9, wherein said groove is situated at a side of a respective step which is distant from the open end of the opening.

11. A closure as defined in claim 9, wherein said groove extends circumferentially about the open end of the opening.

12. A closure as defined in claim 9, wherein said door has a projecting bulge extending into said groove in said closing position of said door and defining a labyrinthine passage therewith.

13. A closure as defined in claim 6; and further comprising at least one sheet member of substantially U-shaped configuration interposable between said door and said frame in the region of said plurality of steps to extend in the circumferential direction of said ridge.

14. A closure as defined in claim 13, wherein said sheet member is removably interposable between said door and said frame.

15. A closure as defined in claim 13, wherein said sheet member is of a resiliently yieldable material.

16. A closure as defined in claim 13, wherein said frame and said door have respective lateral portions and lower and upper portions; and wherein said sheet member is interposable between said door and said frame at least in the region of said lateral and lower portions.

17. A closure as defined in claim 13, wherein said sheet member has two arms and a bight interconnecting said arms; and wherein said bight rests against said door and said arms abut said frame in said closing position.

18. A closure as defined in claim 13, wherein said sheet member has two arms and a bight interconnecting said arms; wherein said frame is provided with a groove; and wherein said bight is received in said groove of said frame, one of said arms abuts against said frame and the other arm rests against said door.

19. A closure as defined in claim 6, and further comprising at least one drip projection on said ridge.

20. A closure as defined in claim 19, wherein said drip projection extends from said ridge in direction toward said contact surface of said frame.

21. A closure as defined in claim 20, wherein said drip projection is provided on the respective step of said plurality which has the largest magnitude.

* * * * *